US006575329B2

(12) United States Patent
Clark

(10) Patent No.: US 6,575,329 B2
(45) Date of Patent: Jun. 10, 2003

(54) INTERFOLDED TOWEL DISPENSER

(75) Inventor: Gerald L. Clark, Tucker, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/977,093

(22) Filed: Oct. 12, 2001

(65) Prior Publication Data

US 2003/0071050 A1 Apr. 17, 2003

(51) Int. Cl.[7] ..... A47K 10/24
(52) U.S. Cl. ..... 221/45; 221/63
(58) Field of Search ..... 221/45, 33, 46, 221/48, 49, 63, 197, 282, 303, 311; 206/449, 556, 494

(56) References Cited

U.S. PATENT DOCUMENTS

| | | | | |
|---|---|---|---|---|
| 3,203,586 A | * | 8/1965 | Downham | 221/55 |
| 4,938,382 A | | 7/1990 | Frazier et al. | |
| 5,118,554 A | | 6/1992 | Chan et al. | |
| 5,950,863 A | | 9/1999 | Schutz et al. | |
| D416,725 S | | 11/1999 | Lewis | |
| D424,853 S | | 5/2000 | Singletary et al. | |
| 6,415,949 B1 | * | 7/2002 | Tramontina | 221/45 |

FOREIGN PATENT DOCUMENTS

| | | |
|---|---|---|
| EP | 1136025 A2 | 9/2001 |
| WO | WO9822009 | 5/1998 |
| WO | WO9840002 | 9/1998 |

OTHER PUBLICATIONS

Catalog pages showing prior art Kimberly–Clark dispensers, 2000.
EPO Search Report dated Oct. 24, 2002.

* cited by examiner

*Primary Examiner*—Kenneth W. Noland
(74) *Attorney, Agent, or Firm*—Dority & Manning

(57) ABSTRACT

A folded paper product dispenser for storing and dispensing a stack of folded paper products such as napkins or towels includes an outer housing defining an interior space to accommodate the stack of folded paper products. A dispensing face is defined by the housing adjacent a bottom of the interior space. A dispensing throat is defined in the dispensing face and extends longitudinally along the face. The dispensing throat has a forwardmost generally concave edge and a finger access portion at the widest width of the throat. A plurality of ribs are disposed in the interior of the housing and extend from a front wall of the housing towards a concave edge of the dispensing throat. The ribs include a central rib having a generally flat vertical end set back from the concave edge of the dispensing throat a first setback distance. Intermediate ribs are provided on each side of the central rib and have a generally curved end-that is set back from the concave edge of the dispensing throat a second distance. The first setback distance of the central rib is greater than the second setback distance of the intermediate ribs.

11 Claims, 4 Drawing Sheets

INTERFOLDED TOWEL DISPENSER

BACKGROUND

Various types of dispensers are known and used in the art for dispensing stacks of folded paper products, such as folded towels or napkins. Typical towel dispensers are shown in WO 98/22009 and WO 98/4004. A line of such dispensers is available from Kimberly-Clark Corporation, including the Scottfold® Folded Towel Dispenser, the Scottfold® Compact Towel Dispenser, the C-Fold Towel Dispenser, and the Multi-Fold Towel Dispenser. Folded towels are available with various fold configurations, including C-fold, M-fold, L-fold, etc. Another type of fold pattern known in the art is the Scottfold® pattern from Kimberly-Clark Corporation and described in U. S. Pat. No. 5,118,554.

A disadvantage with various types of commercial dispensers is that, typically, one particular type of dispenser is generally only suited for dispensing a particular type of folded product. The various fold patterns result in the products having various widths and non-uniform thicknesses across their widths. As a result, the conventional dispensers have been designed to maximize dispensing efficiency with respect to only one particular type of product. For example, the shape and configuration of the dispensing throat in conventional dispensers has generally been dictated by the fold pattern and size of the towels. Various configurations of bumpers and ribs have been provided on the interior of the dispensers to maintain alignment of the towels within the dispenser and arrest movement of the towels as they approach the dispensing throat.

A need exists in the art for a more versatile dispenser that can efficiently dispense various types of folded stacks of paper products, such as napkins or towels, without a noticeable decrease in dispensing efficiency between the different products.

SUMMARY

It is therefore an object of the present invention to provide a versatile dispenser for efficiently dispensing different types of folded paper products, including napkins or towels.

Additional objects and advantages of the invention will be set forth in part in the following description, or may be obvious from the description, or may be learned through practice of the invention.

The present invention provides a folded paper product dispenser for dispensing various folded profiles of stacked paper products, for example stacked and folded paper napkins and paper towels. The dispenser according to the invention is particularly versatile in that it is capable of dispensing at least three different configurations of stacked paper towels without a statistically significant difference in dispensing efficiency. For example, the present dispenser can dispense C-fold, M-fold, and Scottfold® towel configurations without a statistically significant difference in dispensing failure rate between the dispenser and a standard conventional dispenser configured for the particular types of folded towels.

The dispenser includes an outer housing having sides, a front wall, and a back wall. The housing defines an interior space sized to accommodate a vertical stack of the folded paper products. A dispensing face is defined by the housing generally adjacent to a bottom of the interior space. For example, the dispensing face may be defined at least in part by a bottommost wall of the housing, and at least in part by a bottom angled wall of the housing that is adjacent to the bottommost wall. This wall is angled upwards and towards the front wall of the housing.

A dispensing throat is defined in the dispensing face. The throat extends longitudinally along the dispensing face and has a forwardmost generally concave edge defined in the angled wall, and a finger access portion defined by the back edge thereof. The finger access portion may be defined in the bottommost wall of the dispenser. The dispensing throat has a widest width measured across the throat at the widest point of the finger access portion.

A plurality of ribs are disposed in the interior of the housing on the angled wall. These ribs serve to align the stacked configuration of paper products within the housing, present the stacked products at a proper orientation for being pulled through the dispensing throat by a user, and also to arrest movement of the paper products as they approach the dispensing throat. The ribs extend from the front wall of the housing towards the concave forwardmost edge of the dispensing throat.

The ribs include a central rib disposed generally at the widest width of the dispensing throat and set back from the concave edge at a first distance. This central rib may have a generally flat and vertical end adjacent to the concave edge. At least one intermediate rib is disposed on each side of the central rib. The intermediate ribs have a generally flat upper surface and merge into a curved end that is set back from the concave edge of the dispensing throat at a second distance. At least one outboard rib may be disposed outboard of each of the intermediate ribs. The outboard ribs also have a generally curved end that is set back from the concave edge of the dispensing throat at a third distance.

The curved ends of the intermediate ribs and outboard ribs are generally concave and may have a radius of about 1.5. Other curved shapes and radii are also contemplated.

In a particularly useful configuration, the first setback distance of the central rib is greater than the second setback distance of the intermediate ribs. The third setback distance of the outboard ribs is greater than the second setback distance of the intermediate ribs and may be equal to or greater than the first setback distance of the central rib.

The dispensing throat has a width at its widest portion that does not exceed about 2½ inches, and in a particularly useful embodiment is about 2⅛ inches.

The inventive dispenser is described below in greater detail with reference to the figures.

DETAILED DESCRIPTION

Figure 1:
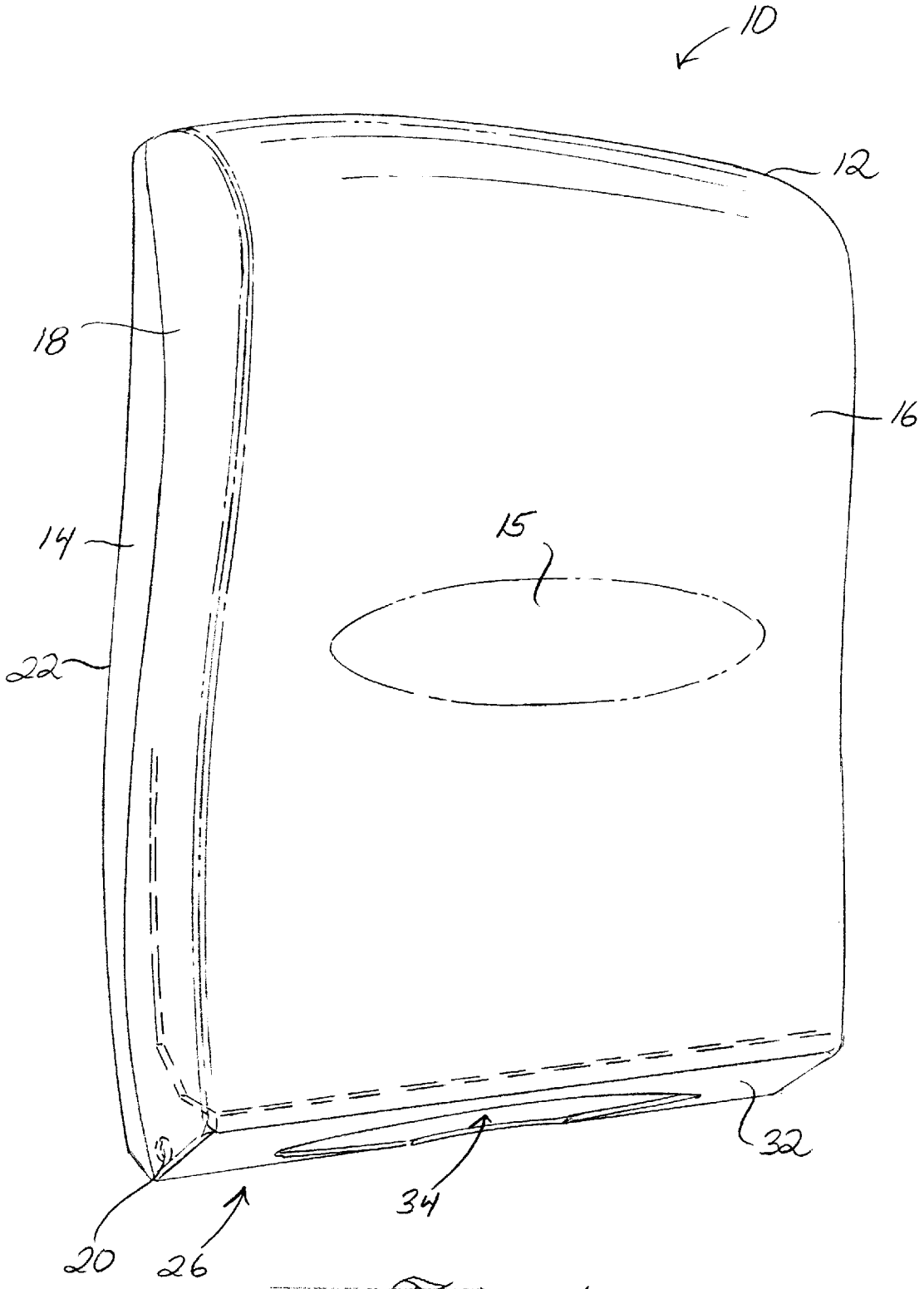
FIG. 1 is a perspective view of a dispenser according to the invention.

Reference will now be made in detail to embodiments of the present inventive dispenser illustrated in the drawings.

This embodiment is provided by way of explanation of the invention, and not meant as a limitation of the invention. Various modifications or variations can be made to the dispenser described and shown herein without departing from the scope and spirit of the invention.

A goal of the present invention was to develop a versatile dispenser that could efficiently dispense various types of folded stacks of paper products, particularly towels folded in a C-Fold, M(Multiple)-Fold, and Scottfold® pattern. The assignee of the present invention, Kimberly-Clark Worldwide, Inc., provides a different type of dispenser for each of the C-Fold, M-Fold, and Scottfold® products. It was desired to design a dispenser that could effectively dispense all three products.

Figure 2:
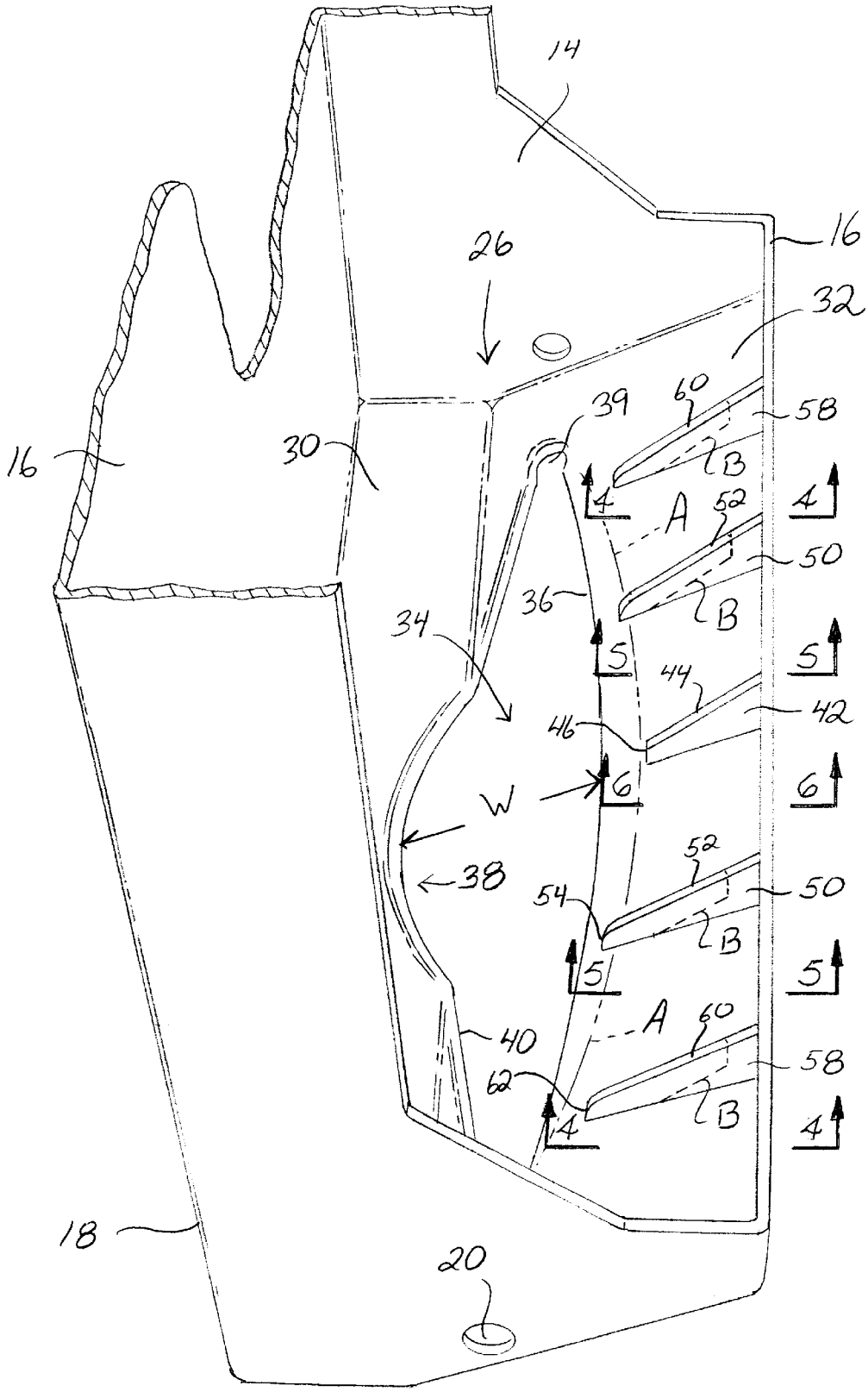
FIG. 2 is a perspective view of the interior side of the front cover of the dispenser particularly illustrating the dispensing throat and rib configuration.

The prior art Scottfold® folded towel dispenser (Model No. 09117) has been used as a dispenser for the Scottfold® products, and was a starting point for design of the present inventive dispenser. The Scottfold® dispenser is illustrated in U.S. Design Pat. No. DES 416,725. This design patent particularly illustrates the shape of the dispensing throat. The 09117 Scottfold® dispenser also utilized a configuration of ribs on the interior angled wall of the dispensing face. Referring to FIG. 2, the rib configuration of the Scottfold dispenser is illustrated by the dashed lines B and the dispensing throat of the Scottfold® dispenser is illustrated by the dashed line A.

It can thus been seen from FIG. 2, that the present inventive dispenser is an improvement upon the 09117 Scottfold® dispenser, wherein such improvement has resulted in a versatile dispenser that is capable of effectively dispensing at least three different types of folded stacked paper towels.

Referring to FIG. 1 in general, the dispenser 10 according to the invention includes a housing 12 having sides 14 and a front wall 16. The housing 12 may include a pivotal front cover member 18 that pivots about a point 20 in order to load a stack of folded napkins or towels into an interior space of the housing 12. A back member 22 is provided with means for mounting the dispenser to a supporting wall surface. A viewing window 15 may be provided in the front cover member 18 so that a technician can easily view the quantity of napkins or towels remaining in the dispenser.

A dispensing face 26 is provided generally adjacent a bottom of the interior space of the housing. The dispensing face in the illustrated embodiment is defined at least in part in a bottommost wall 30, and at least in part in an angled wall 32. The angled wall 32 is angled upwards from the bottommost wall 30 towards the front wall 16 of the dispenser.

A dispensing throat 34 is defined in the dispensing face 26. The dispensing throat defines an opening whereby a user can manually grasp the next available paper towel or napkin and pull the product out of the dispenser housing. In this regard, the dispensing throat 34 extends longitudinally along the dispensing face 26 and has a forwardmost generally concave edge 36 defined in the bottom angled wall 32. A finger access portion 38 is defined by a back edge 40 of the dispensing throat generally in the middle of the throat. This finger access portion 38 extends at least partially into the bottommost wall 30 and provides a space to enhance the ability of a user to grip and pull a paper napkin through the dispensing throat 34. The dispensing throat 38 defines a maximum width W of the dispensing throat, as illustrated in FIG. 2. This width is less than about 2½ inches, and preferably is about 2⅛ inches.

Figure 3:
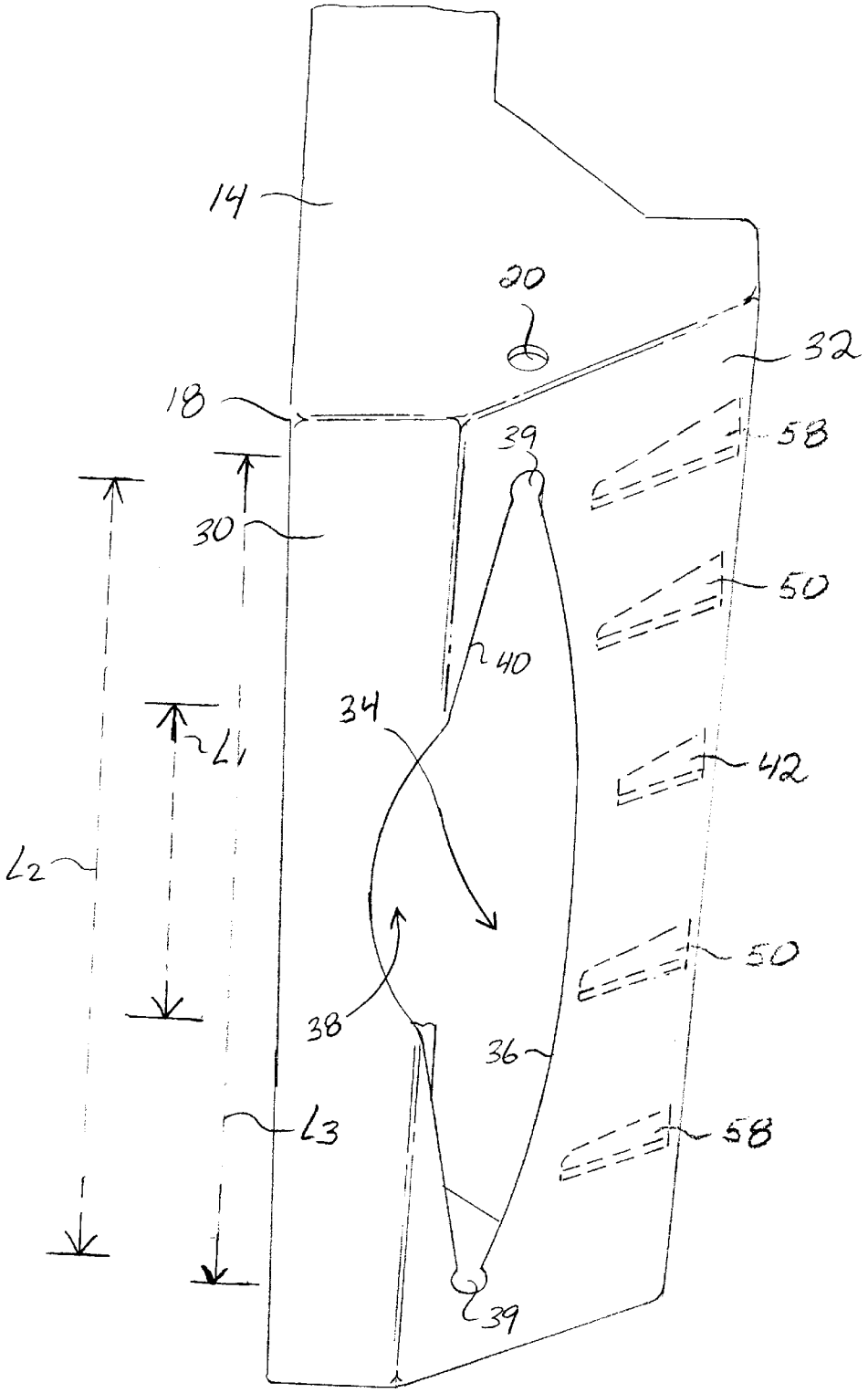
FIG. 3 is a bottom perspective view of the dispensing face of the dispenser particularly illustrating the orientation and location of the various parts of the dispensing throat.
Figure 4:
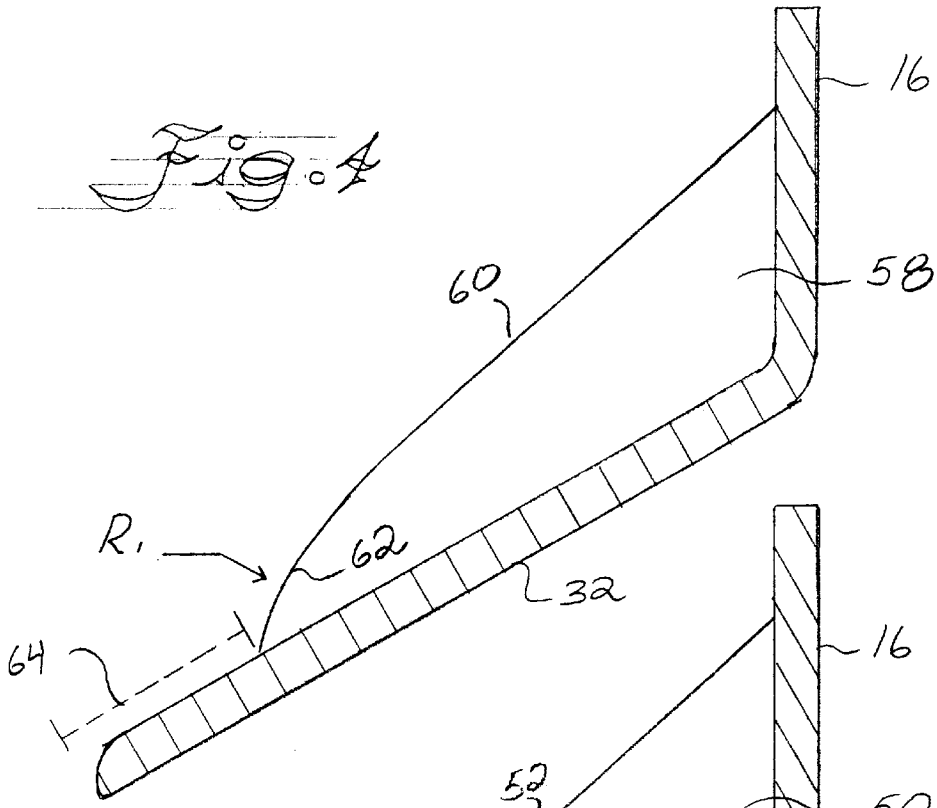
FIG. 4 is a cross sectional view of the outboard ribs taken along the lines indicated in FIG. 2.

Referring to FIG. 3, the finger access portion 38 may be defined by a generally concave section of the back edge 40 and have an overall length L1 of about 3.5 inches. The forward concave edge 36 may have a length L2 of about 8.2 inches. The dispensing throat 34 may have an overall length, including end portions 39 of about 9.0 inches. It should be appreciated that these overall longitudinal lengths can vary depending on the length of the various napkins or towels intended to be dispensed from the dispenser.

Figure 6:
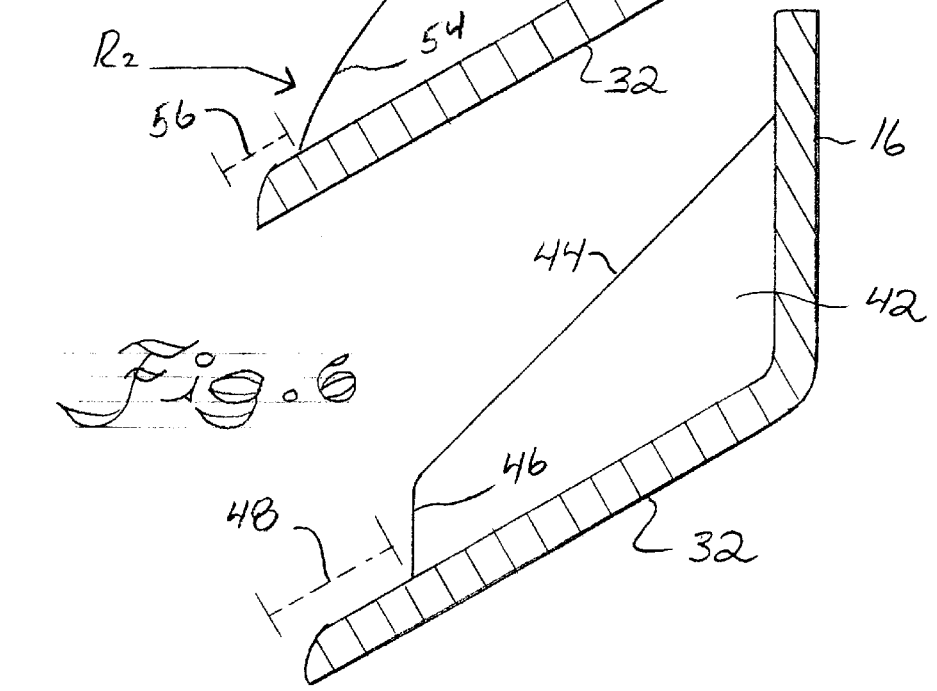
FIG. 6 is cross sectional view of the central rib taken along the lines indicated in FIG. 2.

The dispenser 10 includes a plurality of ribs disposed on the interior side of the angled wall 32, as particularly seen in FIGS. 2 and 3. These ribs extend from the front wall 16 towards the concave edge 36 of the dispensing throat 34. The ribs include a central rib 42 disposed generally at the widest width of the dispensing throat 34, as illustrated in FIG. 2. This central rib 42 extends from the front wall 42 and includes a generally flat angled upper surface 44. The central rib 42 terminates at a generally vertical flat end 46. In the illustrated embodiment, the central rib 42 has a height at the front wall 16 of about 0.7 inches. The angled upper surface 44 extends about 1.0 inches at an angle of about 44 degrees. The vertical end wall 46 is set back from the concave edge 36 at a first setback distance 48 (FIG. 6). In one embodiment, this distance 48 is about ⅜ of an inch.

Figure 5:
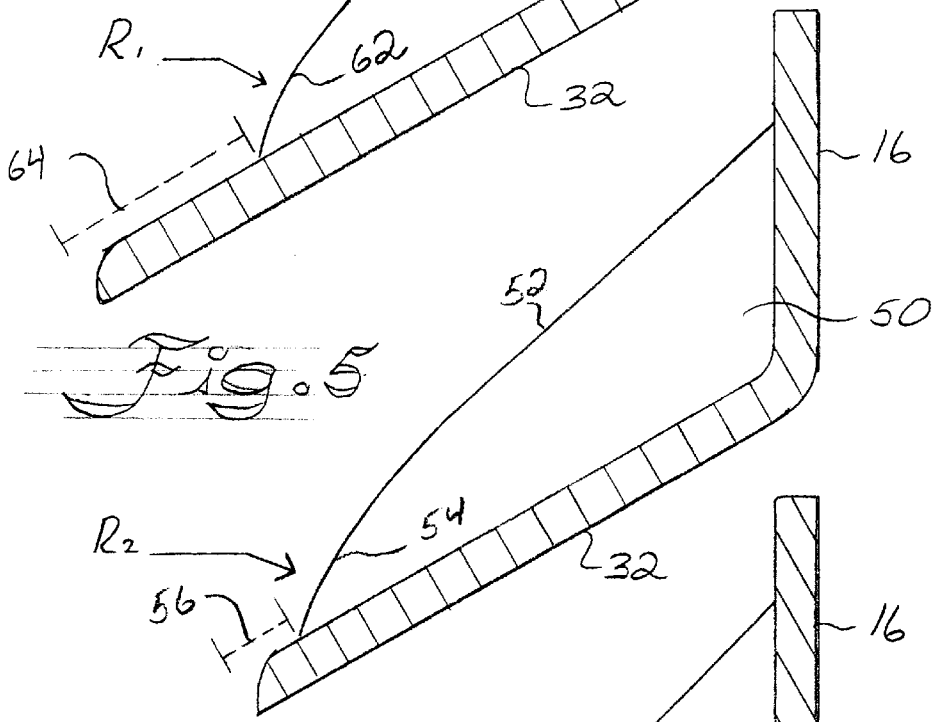
FIG. 5 is a cross sectional view of the intermediate ribs taken along the lines indicated in FIG. 2.

An intermediate rib 50 is provided on each side of the central rib 42. The intermediate ribs 50 also extend from the front wall 16 towards the concave edge 36 and include a generally flat upper angled surface 52. The ribs 50, however, include a curved end 54 that merges with the upper surface 52. This curved end may be generally concave and have a radius R2 (FIG. 5) of about 1.5. The curved end 54 is set back a second setback distance 56 from the concave edge 36. Distance 56 in one embodiment is about 3⁄16 of an inch. The second setback distance 56 is less than the first setback distance 48 for the central rib 42. In the illustrated embodiment, the intermediate ribs have a height at the front wall 16 of about 0.7 inches with an upper surface length of about 1.5 inches. The angled part 52 of the upper surface is at an angle of about 48 degrees.

At least one outboard rib 58 may be provided outboard of each intermediate rib 50. The outboard ribs 58 also extend from the front wall 16 towards the concave edge 36 of the dispensing throat and include a generally flat angled upper surface 60 that merges into a curved end 62. This end 62 may have a radius R1 (FIG. 5) of about 1.5 and is set back a third setback distance 64 from the concave edge 36. Distance 64 in one embodiment is about 7⁄16 of an inch. This third setback distance 64 is greater than the second setback distance 56 for the intermediate ribs 50 and may be equal to or greater than the first setback distance 48 of the central rib 42. In the illustrated embodiment, the outboard ribs have a height at the front wall 16 of about 0.7 inches and an upper surface length of about 1.7 inches. The angled part 60 of the upper surface is at an angle of about 48 degrees.

Referring particularly to FIG. 2, it can be seen that the rib profile and throat width of the prior art 09117 Scottfold® are substantially different from that of the present invention. The rib profile is illustrated in the dashed lines B for the intermediate and outboard ribs. The rib profile included a vertical step portion and an angled surface that terminated at the bottom wall 32. As indicated by the dashed line A, the concave edge 36 of the prior art configuration was substantially directly adjacent to the vertical end 46 of the central rib 42, and at a greater setback distance from the end of the intermediate ribs 50. The unique throat and rib configuration of the present dispenser has been shown to provide for efficient dispensing of C-Fold, M-Fold, and Scottfold® paper towels without a statistically significant deviation between the inventive dispenser and the commercial standard dispenser utilized for each type of folded towel. Table 1 below gives the results of testing of the present dispenser ("Universal") compared to a lab standard dispenser representative of the standard commercial dispenser for each type of folded towel configuration.

TABLE 1

| TOWEL | LAB STRD. DISP. % Failure | UNIVERSAL DISP. % Failure | SIGNIF. DIFF. |
|---|---|---|---|
| C-Fold Avg. | 1.5% St. Dev. 1.6 | Avg. 1.6% St. Dev. 1.6 | Not significant |
| M-Fold | Avg. 0.95% St. Dev. 1.1 | Avg. 1.0% St. Dev. 1.1 | Not significant |
| Scottfold ® | Avg. 0.41% | Avg. 1.1% | Not significant |

The above table summarizes the statistical comparison between a lab standard dispenser for each type of towel (C-fold, M-fold, and Scottfold®) and a Universal dispenser according to the present invention. Tests were conducted on the following types of towels from Kimberly-Clark, Corp.: C-Fold 150, C-Fold 151, C-Fold 2929, M-Fold 180, M-Fold 181, M-Fold 189, Scottfold® 199, and Scottfold® 190. The tests were conducted under a standard set of controlled parameters including temperature, height of dispenser, method of placement of towels in the dispensers, type and force of pulling action, etc. A set number of dispensing "pulls" or operations were conducted for each type of towel and for each type of dispenser and the "failed" dispenses were recorded. A "failure" was noted if a subsequent towel was not available for dispensing upon pulling a first towel from the dispenser, the towel being pulled tore, multiple towels were dispensed in a single pull, more that one towel became visible at the dispensing throat ("bulging"), and if a towel or towels fell out of the dispenser after a dispensing operation. As reflected in the above table, there was not a statistically significant difference between the two dispensers for each type of towel.

It should be appreciated by those skilled in the art that various modifications and variations can be made to the dispenser according to the present invention without departing from the scope and spirit of the invention. It is intended that the invention include such modifications and variations as come within the scope of the appended claims and their equivalents.

What is claimed is:

1. A folded paper product dispenser for storing and dispensing a stack of folded paper products such as towels, said dispenser comprising:

an outer housing having sides, a front wall, and a back wall, and defining an interior space to accommodate a stack of the folded paper products;

a dispensing face defined by said housing generally adjacent a bottom of said interior space, said dispensing face defined at least in part by a bottommost wall of said housing, and at least in part by a bottom angled wall of said housing, said angled wall being angled upwards and towards said front wall;

a dispensing throat defined in said dispensing face, said dispensing throat extending longitudinally along said dispensing face and having a forwardmost generally concave edge defined in said angled wall and a finger access portion at its widest width defined in said bottommost wall;

a plurality of ribs disposed in said interior on said angled wall, said ribs extending from said front wall towards said concave edge; and wherein said ribs include a central rib disposed generally at said widest width of said dispensing throat and set back from said concave edge at a first distance, said central rib having a generally flat and vertical end adjacent said concave edge, and at least one intermediate rib on each side of said central rib, said intermediate ribs having a generally flat upper surface merging into a curved end that is set back from said concave edge at a second distance.

2. The dispenser as in claim 1, wherein said finger access portion is generally concave, and said widest width of said dispensing throat does not exceed about 2.5 inches.

3. The dispenser as in claim 2, wherein said widest width is about 2⅛ inches.

4. The dispenser as in claim 1, wherein said curved end of said intermediate ribs is generally concave and has a radius of about 1.5.

5. The dispenser as in claim 1, wherein said first setback distance of said central rib is greater than said second setback distance of said intermediate ribs.

6. The dispenser as in claim 1, further comprising at least one outboard rib disposed outboard of each said intermediate rib, said outboard ribs having a generally curved end that is set back from said concave edge at a third distance.

7. The dispenser as in claim 6, wherein said curved end of said outboard ribs is generally concave and has a radius of about 1.5.

8. The dispenser as in claim 7, wherein said third setback distance is greater than said second setback distance of said intermediate ribs.

9. A folded paper product dispenser for storing and dispensing a stack of folded paper products such as napkins or towels, said dispenser comprising:

an outer housing having sides, a front wall, and a back wall, and defining an interior space to accommodate a stack of the folded paper products;

a dispensing face defined by said housing generally adjacent a bottom of said interior space, said dispensing face defined at least in part by a bottommost wall of said housing, and at least in part by a bottom angled wall of said housing, said angled wall being angled upwards and towards said front wall;

a dispensing throat defined in said dispensing face, said dispensing throat extending longitudinally along said dispensing face and having a forwardmost generally concave edge defined in said angled wall and an oppositely curved finger access portion at its widest width defined in said bottommost wall;

a plurality of equally spaced ribs disposed in said interior on said angled wall, said ribs extending from said front wall towards said concave edge; and wherein said ribs include a central rib disposed generally at said widest width of said dispensing throat and set back from said concave edge at a first distance, said central rib having a generally flat and vertical end adjacent said concave edge, at least one intermediate rib on each side of said central rib, said intermediate ribs having a generally flat upper surface merging into a curved end that is set back from said concave edge at a second distance that is less than said first setback distance, and at least one outboard rib disposed outboard of each said intermediate rib, said outboard ribs having a generally curved end that is set back from said concave edge at a third distance that is greater than said second setback distance.

10. The dispenser as in claim 9, wherein said curved ends of said intermediate and outboard ribs is generally concave with a radius of about 1.5.

11. The dispenser as in claim 9, wherein said widest width of said dispensing throat is about 2⅛ inches.

* * * * *